US006024213A

United States Patent [19]

Bush et al.

[11] Patent Number: 6,024,213

[45] Date of Patent: Feb. 15, 2000

[54] DISPLAY HANGER FOR BELTS AND COLLARS

[75] Inventors: Carl Edward Bush; William Harry Barnhard, V, both of Wichita, Kans.

[73] Assignee: Rose America Corporation, Wichita, Kans.

[21] Appl. No.: 09/311,051

[22] Filed: May 13, 1999

[51] Int. Cl.[7] ..... B65D 85/18

[52] U.S. Cl. ..... 206/296; 206/493

[58] Field of Search ..... 206/278, 279, 206/284, 288, 289, 292, 293, 295, 296, 775, 493, 495

[56] References Cited

U.S. PATENT DOCUMENTS 2,665,041 1/1954 Maffucci ..... 206/296 X 3,085,725 4/1963 Caparosa ..... 206/292

5,137,149 8/1992 Polacek ..... 206/278

*Primary Examiner*—Jacob K. Ackun

*Attorney, Agent, or Firm*—Richard W. Hanes

[57] ABSTRACT

A hanger for displaying and mounting garment belts and animal collars that include, on one end thereof, a buckle having an open frame with perimetric courses, comprising a belt retaining form having elongated length, parallel straight side edges, planer front and back surfaces and upper and lower ends and being thin and narrow with respect to its length, and including, proximate the upper end thereof, an opening in the upper end of the form for receiving a fixed bracket, a seat, distally spaced from the opening and projecting from the planar front side of the form and having an angular extension at the outward extremity of the seat and adapted to support and retain one course of the belt or collar buckle.

10 Claims, 4 Drawing Sheets

DISPLAY HANGER FOR BELTS AND COLLARS

The present invention relates to a combination hanger and form onto which an article made of narrow belting or webbing may be mounted and hung for consumer display. More particularly, the invention resides in a display hanger for animal collars and garment belts that are provided with a conventional buckle that is constructed with an open frame with perimetric courses.

BACKGROUND OF THE INVENTION

Displaying retail sale products by hanging them from a horizontally disposed supporting rod or similar type of bracket has become a popular and frequently employed device. Such a method is in common use for everything from belts and socks to camera film.

Goods made with belting or webbing type of materials and especially those having open frame buckles on one end thereof lend themselves especially to a display of the type described. Some of the devices for retail of display of belts have been the subject of prior U.S. patents, such as the ones to George Smilow, U.S. Pat. Nos. 4,063,669, 4,453,655 and 4,930,692. All of these patents related to a hook type of hanger from which depends a short body element that engages and retains a number of different type of buckles. In each case, and in other known belt display devices, once the buckle is secured to a hanger, the belts dangle in loose disarray at a variety of angles, curves and bents, creating a disorganized appearing and untidy display.

Accordingly, it is the object of the present invention to provide a combination display hanger and form around which a product made of belting type material may be strung for display purposes.

Another object of the invention is to provide a display and mounting device that will improve the appearance of belting type of product displays including garment belts, animal collars and the like.

A further object of the invention is to provide apparatus for mounting and hanging a belting type of product that will reduce the risk of loss through shoplifting.

A still further object of the invention is to provide a novel article for attaching a belting material type of product to a display hanger.

Other and still further objects features and advantages of the invention will be pointed out or will become apparent upon a reading of the following detailed description of a preferred form of the invention, taken in connection with the accompanying drawings.

SUMMARY OF THE INVENTION

The present invention is an article of manufacture comprising an elongated narrow form around which a belting material product is strung and bound. The form includes at its upper end an opening through which a rod or other type of supporting bracket may be inserted. Distally spaced apart from the bracket receiving opening is a clip, hook or partially enclosed seat that receives, retains and supports one of the courses of an open frame type of buckle member that is attached to the belting material.

DETAILED DESCRIPTION

It shall be understood that the display form of the present invention is intended to accommodate all leather, fabric, rubber and webbing belting material products, whether they are intended for use as garment belts or small animal collars or for any other purpose. Because small animal collars are relatively short, compared to garment belts, a display hanger and mounting form for such a collar may be made shorter and more compact than that for a garment belt. Accordingly, the following description will refer to a display hanger for an animal collar, but such a description is not intended to limit the scope of the invention.

Figure 1:
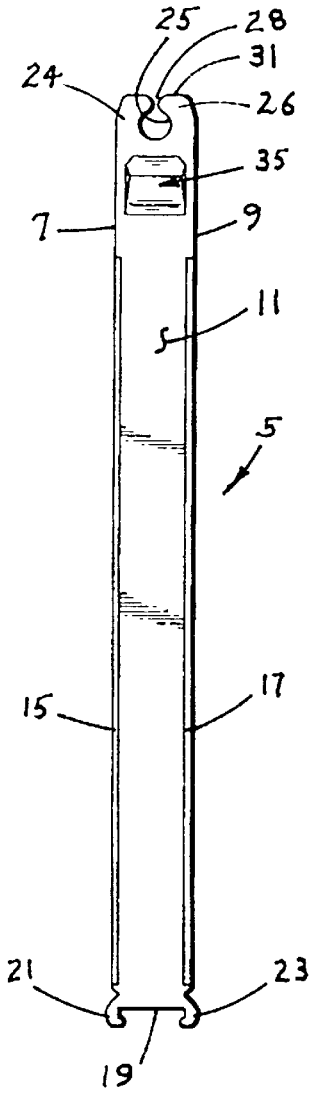
FIG. 1 is a front elevational view of the display form of the present invention.
Figure 2:
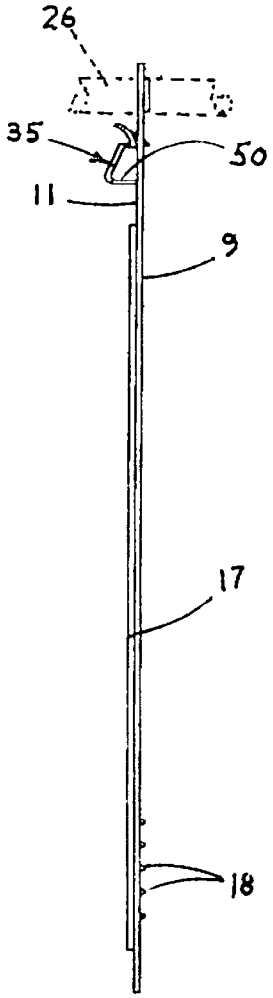
FIG. 2 is a side elevation view of the display form of the present invention.
Figure 3:
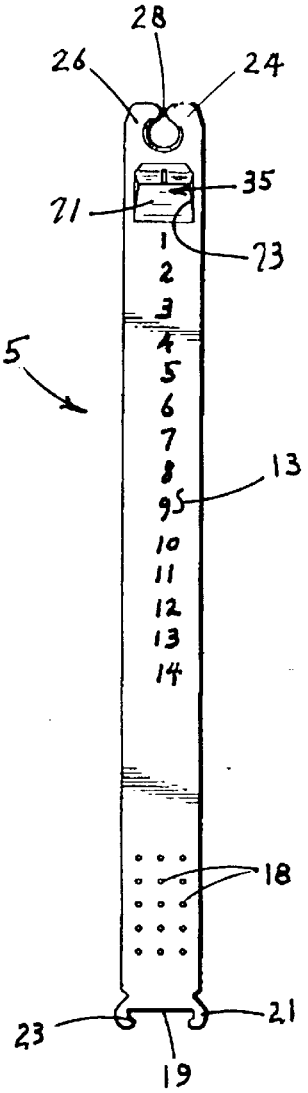
FIG. 3 is a rear elevation view of the display form of the present invention.
Figure 4:
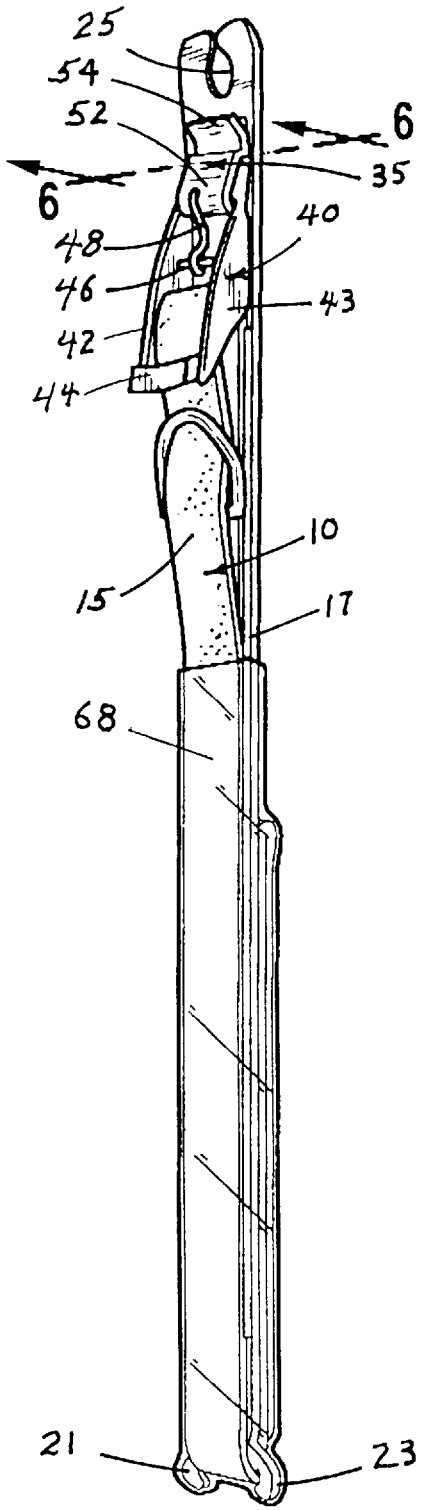
FIG. 4 is a three-quarter frontal perspective view of the display form having an exemplary animal collar strung thereon for retail display.
Figure 5:
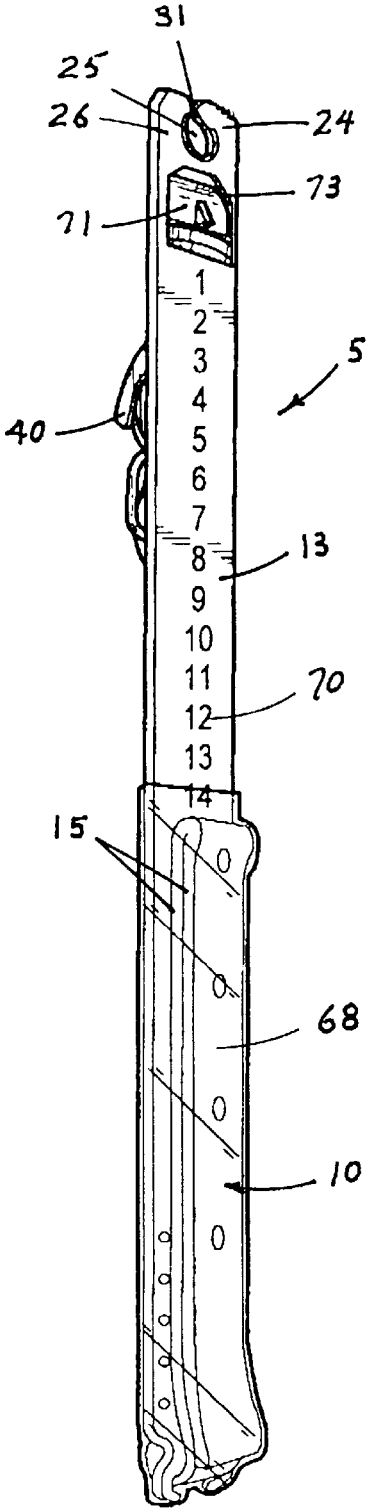
FIG. 5 is a three-quarter rearwardly looking perspective view of the display form of FIG. 4.

Referring first to FIG. 1, the belting form 5 of the present invention is shown as it appears from the front before a collar is strung over and mounted upon the form. Preferably, the form is injected molded with an appropriate plastic as a single unitary piece, although constructing the form's component elements from different pieces will nevertheless accomplish the objects of the invention. The form is molded into a long straight shape of such width as to accommodate between its side margins 7 and 9 the width of belting material to be strung thereon. The length of the form is selectively determined from the length of the webbing or belting material to be borne by the form. In FIGS. 4 and 5 a collar 10, comprising a length of webbing material 15 with an end mounted buckle 40 is shown strung on a form 5 wherein the buckle retaining end of the collar is positioned at the upper end of the form over lying its front surface 11. The collar is trained along and over the front surface of the form, around the distal end thereof and up along and over the form's back surface 13. The end of the collar may be doubled back on itself in order to reduce the length of the form.

Ribs 15 and 17 that rise above the level of the form's front surface 11 may be disposed along a substantial portion of the length of the side edges 7 and 9. The ribs act as fences to maintain the webbing 15 of the collar 10 within the confines of the form's length.

Located at the bottom end 19 of the form 5 and integral therewith are a pair of spaced apart and opposing brackets 21 and 23. The brackets extend outwardly from and are coplanar with the form 5. The webbing 15 of the collar 10 is trained through the inner-space between the brackets 21 and 23. These brackets serve to retain the webbing material in alignment with the form and also as a restraining anchor for the portion of the collar webbing that turns around the end 19 of the form 5.

A plurality of spaced apart nibs, or small projecting points 18, obtrude from the rear surface 13 of the form to engage the webbing material of the collar in order to adhere it to the rear surface 13. If leather or some similar dense material is to be strung on the form, the nibs may not be necessary or desirable.

Disposed longitudinally over the back side 13 of the form 5 are a plurality of numbers 70 that can be referred to as an indication of the length of the belt or collar 10 that is carried by the form. In order to shorten the required length of the form 5, the collar is doubled over on the back side of the form and the length of the collar is read from the indicia printed on or molded into the surface 13 of the form.

Disposed at the top end of the form is an opening 25 through which a supporting rod 26 may be inserted for the hanging of the display device. The opening may be of any shape or size that will accommodate the supporting bracket. The top of the form may also be provided with a slit 28 that interconnects the top peripheral edge 31 of the form and the opening 25. If the material of which the form is constructed is sufficiently flexible, the slit will enable the upper 'ears' 24 and 26 of the form to be distorted out of their quiescent plane, allowing the form to be pulled off or pushed onto the supporting bracket 26 without having to insert the end of the bracket into the opening.

Distally spaced from the opening 25 is a clip, hook or seat assembly 35 that receives, retains and supports one of the courses of an open frame type of buckle member 40 that is attached to the belting material. A conventional buckle of the type found on most small animal collars is of the open frame type having perimetric courses, or sides, 41, 42, 43 and 44, that define the frame of the buckle. A centrally disposed cross member 46 traverses the width of the inner-space between the side courses 42, 43 of the buckle frame and pivotally supports a pointed prong 48 that is inserted into holes in the end of the collar in a well known manner.

In the preferred form on the invention, the clip, hook or seat assembly 35 comprises an integral seat 50 projecting outwardly at approximately a right angle from the face or front surface 11 of the form. The purpose of the projection is to act as a seat or support for the end course 41 of the collar buckle 40. The projection 50 is dimensioned and sized to accommodate the end course of the buckle. At the outward end of the required seat 50 the integral plastic material changes direction to proceed as an extension 52 in a proximate direction and at less than a right angle to the seat and angularly to the front surface 13 of the form so as to be inclined toward the form's front surface.

Figure 6:
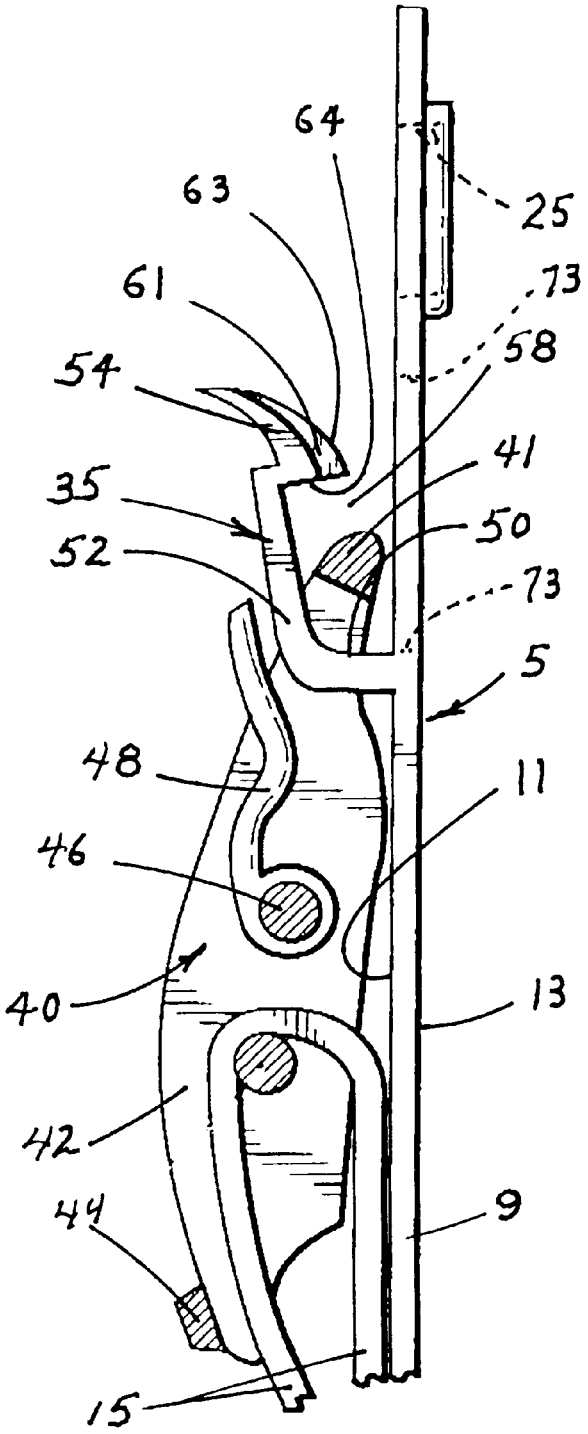
FIG. 6 is an enlarged fragmentary cross sectional view taken along lines 6—6 of FIG. 4 showing the buckle retaining seat in a drawn back or retracted position for insertion or removal of the buckle of the belting device.

The nature of the plastic material from which the form 5, the seat 50 and the seat's extension 52 are constructed is such as to create a springing action of the seat and its extension with respect to the front surface of the form 5. That is, if the top edge 54 of the extension is manually pulled away from the front surface 11 of the form and released, the extension will elastically return to its original angular position. This springable or elastic character of the seat and its extension creates a means for inserting the end course of the buckle into the space 58 between the extension and the front surface 11 and then provide a retention for the buckle that will secure it in place until the extension is again pulled outwardly a sufficient distance to allow the end course of the buckle to be lifted out of the space 58 and free of its enclosure behind the extension 52. A rib 61 rearwardly extending from the rear face of the seat extension 52 assists in maintaining the buckle in the seat. The top edge 63 of the rib 61 is inclined so as to allow the end course of the buckle to slide down the edge when the buckle is inserted into the space 58. However the underside edge 64 of the rib 61 is made approximately perpendicular to the front surface 11 of the form. For removal of the buckle, this construction requires that the seat extension 52 be purposely drawn back a distance sufficient to allow the end course 41 to pass around the rib 61, as seen in FIG. 6.

To accommodate the molding process and provide additional space for the buckle course, a portion 71 of the form behind the seat extension may be omitted, or relieved. That portion is preferably bounded by a border 73 that defines a normal projection of the seat extension onto the front surface 13 of the form.

To better secure the collar webbing to the form, a plastic shrink wrap 68 may be applied around a portion of the form around which the webbing is strung. Alternatively to the shrink wrap a tie may be placed around the webbing as it is strung on the front and rear of the form. It is probable that the shrink wrap or the tie might be individually sufficient to secure the belting to the form, however, without the presence of the restraining buckle seat assembly 35, the product would be prone to slip downwardly off of the form. Furthermore, without the advantages of the seat assembly 35 a shoplifter might easily slip the product out of the confines of the shrink wrap or the tie. With the restraining buckle assembly 35 a very conscientious and conspicuous effort must be put forth to remove the buckle from its restraining seat assembly 35, thus reducing the opportunity for clandestine theft of the product while leaving the supporting form and accompany anti-theft devices on the display rack.

I claim:

1. A hanger and interconnected form for displaying and mounting garment belts and animal collars that include on one end thereof a buckle having an open frame with perimetric courses, comprising, a belt retaining form having elongated length, parallel straight side edges, planer front and back surfaces and upper and lower ends and being thin and narrow with respect to its length, and including, proximate the upper end thereof, an opening in the upper end of the form for receiving a fixed bracket, a seat, distally spaced from the opening and projecting from the planar front side of the form and having an angular extension at the outward extremity of the seat and adapted to support and retain one course of the belt or collar buckle.

2. The display hanger of claim 1 and further including at least one longitudinal rib raised above the planer front surface of the form and extending along at least a portion of at least one of the side edges of the form.

3. The display hanger of claim 1 and further including at the lower end of the form a pair of spaced apart brackets, coplanar with the form, to engage the sides of the belt or collar that is borne by the form in order to retain the same in alignment with the form.

4. The display hanger of claim 1 and further including a plurality of spaced apart nibs projecting from at least of the planar surfaces.

5. The display hanger of claim 1 where the seat and the angular extension are springable.

6. A hanger and interconnected form for displaying and mounting garment belts, animal collars and the like that include a buckle having an open frame with perimetric courses, comprising, a belt retaining form having elongated length, parallel straight side edges, planer front and back surfaces and upper and lower ends and being thin and narrow with respect to its length, and including, proximate the upper end thereof, an opening in the upper end of the form for receiving a fixed bracket, a seat, distally spaced from the opening and projecting from the planar front side of the form and having an angular extension at the outward extremity of the seat and adapted to support and retain one course of the belt or collar buckle, a longitudinal rib raised above the planer front surface of the form and extending along at least a portion of each of the side edges of the form, disposed at the lower end of the form, a pair of spaced apart brackets, coplanar with the form, to engage the sides of the belt or collar that is borne by the form in order to retain the same in alignment with the form.

7. The combination of claim 6 and further including a plurality of spaced apart nibs projecting from at least one of the planar surfaces.

8. The combination of claim 7 where the seat and the angular extension are springably movable with respect to the front surface of the form.

9. The combination of claim 8 wherein the form is relieved in an area bounded by a normal projection of the angular extension.

10. The combination of claim 6 and further including indicia disposed longitudinally of the back surface of the form to serve as an index of the length of the belt or collar that is borne by the form.

* * * * *